United States Patent [19]

Knebel et al.

[11] 4,227,994

[45] Oct. 14, 1980

[54] OPERATION OF A COAL DEASHING PROCESS

[75] Inventors: Alfred H. Knebel; Donald E. Rhodes, both of Oklahoma City, Okla.

[73] Assignee: Kerr-McGee Corporation, Oklahoma City, Okla.

[21] Appl. No.: 887,870

[22] Filed: Mar. 20, 1978

[51] Int. Cl.[2] ..... C10G 21/20; C10G 21/16; C10G 21/14

[52] U.S. Cl. ..... 208/177

[58] Field of Search ..... 208/177, 8 LE

[56] References Cited

U.S. PATENT DOCUMENTS

| | | | |
|---|---|---|---|
| 3,075,912 | 1/1963 | DuBois-Eastman et al. | 208/8 LE |
| 4,070,268 | 1/1978 | Davis et al. | 208/8 LE |
| 4,077,866 | 3/1978 | Owen et al. | 208/8 LE |
| 4,134,821 | 1/1979 | Gorin | 208/8 LE |

*Primary Examiner*—George Crasanakis
*Attorney, Agent, or Firm*—William G. Addison

[57] ABSTRACT

A process for maintaining the fluid-like properties of separate phases formed within a continuous coal deashing process during periods in which the flow of feed to the apparatus is interrupted. In operation, when the flow of feed is interrupted, the flow of solvent to the separation apparatus of the coal deashing process is diverted about said apparatus in such a manner as to maintain the system operating pressure. More specifically, solvent maintained at elevated temperature and pressure is diverted about the mixing and separation apparatus and introduced into a conduit downstream of the separation zone, in advance of a pressure regulating valve, said conduit also connecting to the separation apparatus. The new flow path maintains the pressure within the separation zone through establishment of fluid communication between the elevated pressure solvent and the phases within the separation apparatus. In one embodiment, a heating fluid is circulated through heating jackets surrounded said separating apparatus to maintain the system operating temperature. Resumption of continuous operation is effected by returning the solvent to its former flow path in the apparatus when the flow of feed is restored.

8 Claims, 1 Drawing Figure

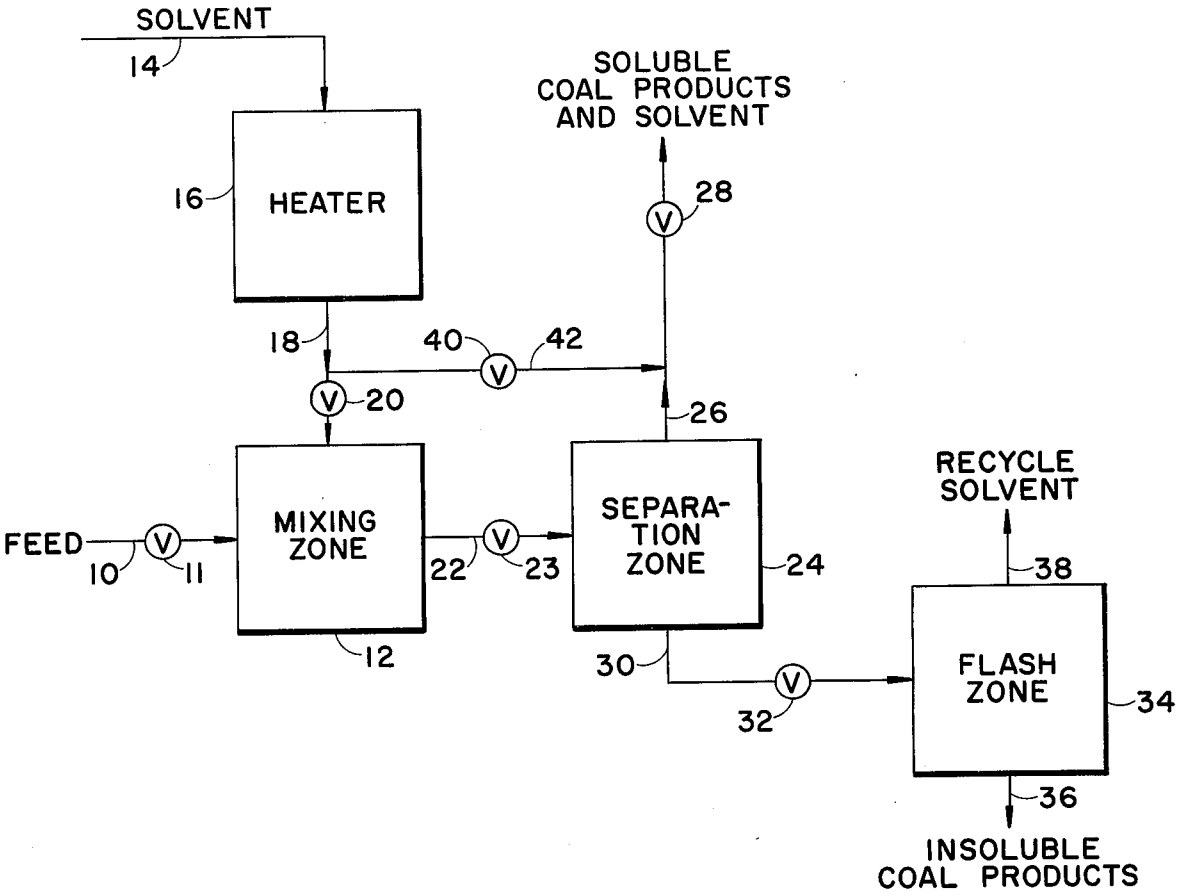
SOLVENT
14
HEATER
16
18
20
40
42
FEED
10
11
MIXING ZONE
12
22
23
SEPARA-TION ZONE
24
26
28
SOLUBLE COAL PRODUCTS AND SOLVENT
30
32
FLASH ZONE
34
36
INSOLUBLE COAL PRODUCTS
38
RECYCLE SOLVENT

OPERATION OF A COAL DEASHING PROCESS

CROSS-REFERENCE TO RELATED APPLICATIONS

The subject matter of this application relates to copending application Ser. No. 888,299 entitled "Use Of Deashed Coal As A Flushing Agent In A Coal Deashing Process" filed of even date herewith.

BACKGROUND OF THE INVENTION

1. Field of the Invention

This invention relates to a process by which improved operation of a continuous coal deashing process can be effected, and more particularly but not by way of limitation, to a process for maintaining the fluidity of fluid-like phases formed during the deashing process.

2. Description of the Prior Art

Various coal deashing processes have been developed in the past wherein coal has been treated with one or more solvents and processed to separate the resulting insoluble coal products from the soluble coal products.

U.S. Pat. Nos. 3,607,716 and 3,607,717, assigned to the same assignee as the present invention describe processes wherein coal liquefaction products are contacted with a solvent and the resulting mixture is separated into a heavy phase containing the insoluble coal products and a light phase containing the soluble coal products. In such processes, the light phase is withdrawn and passed to downstream fractionating vessels wherein the soluble coal products are separated into multiple fractions.

The separation is effected in these processes by maintaining rigorous control of the process conditions. The failure to maintain the required conditions often will cause the process to become inoperable.

In the event the process conditions are not maintained, the heavy phase, which exhibits fluid-like properties under the operating conditions of the process, solidifies into a solid mass. The solidified mass, once formed, will not regain the fluid-like properties upon return of the process conditions of their former limits. Further, the solid has a tendency to spall away from the surfaces of the apparatus on which it has formed and to plug additional downstream apparatus. Thus, operation of the coal deashing process must be discontinued to permit maintenance personnel access to the apparatus to remove the solidified material. To effect the solids removal, it is necessary to disassemble and mechanically clean the interior of the apparatus and conduits leading to downstream apparatus.

It would be desirable to provide a process by which, in the event the operating conditions of the coal deashing process were not maintained, the formation of the solidified mass can be avoided and continuous operation can be maintained without the necessity of dissassembling the apparatus and conduits.

SUMMARY OF THE INVENTION

The discovery now has been made that the fluid-like properties of the phases separated within a continuous coal deashing process can be maintained by the process hereinafter set forth during periods in which the flow of feed to the deashing process is interrupted. In operation, the flow of solvent within the coal deashing apparatus is diverted from the mixing and separating apparatus to form a new flow path which maintains the operating pressure of the system.

More specifically, during normal operations solvent and feed are continuously mixed and introduced into a separation zone maintained at elevated temperature and pressure. The elevated temperature principally is achieved by heating the solvent. The elevated pressure principally is achieved through pumping of the solvent and controlling the expansion of the solvent upon heating such that internal pressure develops. The pressure is maintained by a continuous flow of a separated light phase comprising soluble coal products and solvent from the separation apparatus through a pressure regulating valve in the deashing process system. When the flow of feed is interrupted, the flow of elevated temperature and pressure solvent is diverted about the mixing and separating apparatus through a conduit which connects to the conduit through which the separated light phase flows, in advance of the pressure regulating valve. The flow of elevated temperature and pressure solvent through the pressure regulating valve maintains the pressure of the phases within the separation apparatus by fluid communication between the solvent and the phases via the connecting conduits. The temperature level within the apparatus, through which solvent flow is discontinued, is maintained, for example, by passage of a heating fluid through jackets which enclose said apparatus.

BRIEF DESCRIPTION OF THE DRAWING

The single FIGURE diagrammatically and schematically illustrates one preferred embodiment of the invention.

DESCRIPTION OF THE PREFERRED EMBODIMENT

Turning now to the drawing, during normal operations a feed comprising coal liquefaction products is introduced into a mixing zone 12 through a conduit 10 and a valve 11 interposed therein from a source not shown. The coal liquefaction products comprise soluble coal products and insoluble coal products. The feed can be the product or any fraction thereof of any coal liquefaction process in which raw coal or other carbonaceous material is contacted with a liquefaction process solvent to solubilize a portion thereof to yield liquefaction products. The valve 11 can comprise, for example, a one-way flow valve or a block valve.

Solvent, flowing in a conduit 14 from a source not shown, enters a heater 16 wherein the solvent is heated to an elevated temperature and pressure level. More specifically, the solvent is heated to a temperature level in the range of from about 400 degrees F. to about 700 degrees F. The pressure level is elevated to a level above about 550 psig. Preferably the pressure level is in the range of from about 600 psig to about 1500 psig, however higher pressures may be employed. The heated solvent is discharged from heater 16 through a conduit 18 to enter the mixing zone 12 via passage through a block valve 20 interposed therein. The block valve 20 is in the open position during normal operating conditions.

In the mixing zone 12 the feed is contacted by and mixed with the solvent to provide a feed mixture. Sufficient solvent is introduced into the mixing zone 12 to provide a ratio by weight of solvent to feed in the feed mixture of from about 1:1 to about 10:1. It is to be understood that larger quantities of solvent can be used, however such use is uneconomical. The feed mixture is discharged from the mixing zone 12 through a conduit 22 and a valve 23 interposed therein to enter a separation zone 24. The mixing zone 12 can comprise any of those devices know to the art which are capable of effecting an intimate mixing of the feed and solvent therein. In one preferred embodiment, the mixing zone comprises a static in-line mixer. The valve 23 can comprise, for example, a one-way flow valve or a block valve.

The separation zone 24 is maintained at a temperature level in the range of from about 400 degrees F. to about 700 degrees F. and a pressure level in the range of from about 600 psig to about 1500 psig to effect a separation of the feed mixture into a light phase comprising the soluble coal products and solvent and a heavy phase comprising the insoluble coal products and some solvent. The temperature control within the separation zone preferably principally is achieved by controlling the temperature of the heated solvent which is mixed with the feed to form the feed mixture that is introduced into the separation zone.

The light phase continuously is withdrawn from the separation zone 24 via a conduit 26 to flow to subsequent downstream processing apparatus (not shown) via passage through a pressure regulating valve 28 interposed therein. The pressure regulating valve 28 controls the flow rate of the light phase from the separation zone 24 to maintain the pressure within the separation zone 24 within the predetermined limits principally by controlling the expansion of the heated solvent contained therein.

The heavy phase is withdrawn from the separation zone 24 through a conduit 30 and a pressure reduction valve 32 interposed therein to enter a flash zone 34. In flash zone 34, the heavy phase is flashed to produce at least one stream comprising the insoluble coal products and one other overhead stream comprising the solvent. The insoluble coal products stream is withdrawn from the flash zone 34 through a conduit 36 for recovery. The solvent stream is withdrawn from the flash zone 34 through a conduit 38 for recycle in the coal deashing process to aid in providing the feed mixture.

In the event the flow of feed entering the mixing zone 12 through conduit 10 is interrupted, the conditions within the separation zone 24 will begin to change. If the solvent is permitted to continue to flow through block valve 20 and eventually into the separation zone 24, the heavy phase contained therein will be over-extracted. Over-extraction of the heavy phase results in the formation of an undesirable non-flowable solid mass. This solid mass, once formed, must be removed mechanically from the apparatus comprising the separation zone 24. Thus, the continuous operation of the deashing process must be discontinued.

If the flow of solvent is stopped, as well as the flow of feed, the temperature and pressure within the separation zone begin to change. When the conditions change sufficiently such that they are no longer within the predetermined limits, the heavy phase within the separation zone 24 and conduit 30 will become and undesirable solidified mass. This solidified mass, once formed, will not regain the desired fluid-like properties of the heavy phase upon resumption of process operations. The solidified mass must be mechanically removed to enable continuous operation to resume. If conditions are such that only a small amount of the undesirable solidified material has formed before operations are returned to the predetermined conditions, the solidified mass that has been formed can spall away from the surfaces within the apparatus upon which it formed and cause the pressure reduction valve 32 and other downstream apparatus to plug.

The process of the present invention eliminates the formation of the solidified mass or solids within the deashing process apparatus during an interruption of the feed to the deashing process apparatus. In operation, the process of this invention diverts the solvent around the mixing zone 12 and the separation zone 24 while maintaining the designated operating conditions within the mixing zone 12 and the separation zone 24 to preserve the fluid-like properties of the heavy phase contained therein.

To more fully describe the present invention two forms of feed interruption are described. One form of feed interruption is voluntary interruption. The desire to voluntarily interrupt the flow of feed to the continuous deashing process apparatus may arise, for example, as a result of the failure of downstream processing apparatus or the need to perform normal maintenance upon the pumps or valves forming a part of the deashing process apparatus. The second form of feed interruption described is involuntary or unavoidable interruption. Unavoidable interruption can arise from failure of the feed pump, plugging of pressure reduction valve 32, plugging of conduit 30 or any other unexpected apparatus failure.

In the event it is desired to voluntarily interrupt the flow of feed in conduit 10, block valve 20 (normally open) is closed. The flow of feed in conduit 10 is continued until the mixture of solvent and feed within the mixing zone 12 is displaced therefrom and introduced into the separation zone 24. Upon displacement of the feed mixture from the mixing zone 12, the flow of feed is terminated and the pressure reduction valve 32 also is closed.

In the event valve 11 is a block valve (normally open), valve 11 is closed to prevent pressure loss from the separation apparatus through conduit 10. If valve 11 is a one-way flow valve, it automatically seals against reverse flow which would result in pressure loss. Alternatively, valve 23 in conduit 22 can be employed to prevent the pressure loss from the separation apparatus.

If the voluntary interruption is of sufficient duration that the feed contained in conduit 10, mixing zone 12 or, if valve 23 is used, conduit 22 has cooled to a point that it is no longer fluid, it can be returned to its fluid condition by controlled reheating. The reheating can be effected, for example, through introduction of a heating fluid into jackets which surround the conduits 10 and 22 and the mixing zone 12. Alternatively, the feed contained in those lines can be maintained in a fluid condition by, for example, immediately introducing heating fluid into jackets surrounding said apparatus to maintain the feed at a constant temperature level. However, as previously indicated, this is not necessary as the feed will regain its fluid properties upon subsequent reheating when process operation is resumed.

Substantially simultaneous with the closing of block valve 20, a diverter valve 40 interposed in a conduit 42 connected to conduit 18 is opened. The heated solvent discharged from the heater 16 now flows through conduit 42 which connects with conduit 26 to pass through pressure regulating valve 28. The flow of heated solvent through pressure regulating valve 28 maintains the pressure within the conduit 26 immediately forward of the pressure regulating valve within the predetermined limits. Since the solvent in conduits 42 and 26 is in fluid communication with the now static phase within the separation apparatus of separation zone 24, the pressure exerted by the solvent in conduit 26 against the pressure regulating valve 28 also substantially is exerted against the static phases within the separation apparatus. Thus, the flow of heated solvent maintains the pressure of the separation apparatus within the predetermined limits. The separation zone 24's temperature level is maintained, for example, through passage of a heating fluid through a heating jacket which surrounds the apparatus of the separation zone 24. In one embodiment, the heating fluid is superheated steam. Other suitable heating fluids include, for example, Therminal ® 66 (terphenyl) and Therminal ® VP-1 (a mixture of diphenyl and diphenyl oxide) produced by Monsanto Industrial Chemicals Co, St. Louis, Missouri. Thus, the light phase and heavy phase contained in the separation zone 24 are maintained in a state of equilibrium such that the composition of the phases substantially does not change and the heavy phase retains its fluid-like properties.

Deashing process apparatus operation is resumed by closing diverter valve 40 and reopening block valve 20 to introduce solvent into the mixing zone 12. Then, the flow of feed is resumed in conduit 10 and pressure reduction valve 32 in conduit 30 is reopened.

In the event the flow of feed in conduit 10 is unavoidably interrupted before the feed mixture within the mixing zone 12 can be displaced, the block valve 20 (normally open) is closed and valve 11, if a block valve, also is closed. If valve 11 is not a block valve, it is preferred the valve be of a type such that upon cessation of flow therethrough, reverse flow is prevented. Substantially simultaneous with the closing of block valve 20, block valve 40 (normally closed) in conduit 42 is opened. The heated solvent flows through conduits 42 and 26 as previously described to maintain the pressure within the separation apparatus within the predetermined limits. The pressure level within the mixing zone 12 is maintained by communication established between the mixing zone 12 and separation zone 24 via conduit 22. The pressure reduction valve 32 in conduit 30 also is closed as previously described.

Since mixing zone 12, conduit 22 and separation zone 24 all contain feed mixture which separates at the elevated temperature and pressure of the system into the light phase and the heavy phase, it is necessary to maintain all of said apparatus at the predetermined elevated temperature to avoid the formation of non-flowable solids therein. The temperature in separation zone 24 is maintained, for example, by passing heating fluid through heating jackets surrounding the separation apparatus. Heating fluid also can be introduced into heating jackets surrounding the mixing zone 12 and conduit 22 to maintain the temperature conditions within the predetermined limits. The heating maintains the fluids within the mixing zone 12 and the conduit 20 in equilibrium along with the fluids in separation zone 24 such that the heavy phase fluid is not permitted to form a solidified mass which would plug the apparatus.

The process of the present invention is further illustrated by the following examples. The feed used comprised a coal liquefaction product which was analyzed and found to have the analyses set forth in Table 1 below.

TABLE I

| | |
|---|---|
| Specific Gravity | |
| 60/60 | 1.34 |
| Proximate Analyses | |
| % loss at 105° C. | 0.4 |
| % volatile matter | 44.7 |
| % fixed carbon | 41.5 |
| % ash | 13.4 |
| Ultimate Analyses | |
| % Carbon | 74.3 |
| % Hydrogen | 5.3 |
| % Nitrogen | 1.5 |
| % Sulfur | 2.0 |
| % Oxygen (diff.) | 3.5 |

The feed is introduced into the mixing zone 12 to contact the solvent (comprising benzene) in a ratio of about one part by weight of feed to five parts by weight of benzene at a temperature level in the range of from about 525 degrees F. to about 550 degrees F. and a pressure level of about 780 psig to about 800 psig. The feed mixture then flows through conduit 22 to enter the separation zone 24. The apparatus in separation zone 24 is controlled to operate at a temperature level of about 550 degrees F. and a pressure level of about 780 psig.

EXAMPLE

Four runs are set forth to illustrate the present invention when the flow of feed in conduit 10 is interrupted. Specifically, one run continues the flow of solvent through the separation zone 24 apparatus. In the second run, the flow of solvent is discontinued. In the third run, the solvent is diverted through conduit 42 and the feed mixture is displaced from the mixing zone 12 by feed prior to interruption. In the fourth run, the solvent is diverted through conduit 42 and the feed mixture is not displaced from the mixing zone 12 prior to feed interruption.

In each instance, resumption of process operation was attempted by once again introducing feed into the mixing zone 12 with solvent.

In the first run in which the flow of solvent is continued after feed interruption, the separation zone 24 apparatus is found to contain a solid mass which can not be returned to a fluid-like state upon resumption of process conditions and which plugged conduit 30. In the second run in which the flow of solvent is discontinued after feed interruption, the separation zone 24 apparatus again is found to contain a solid mass that can not be returned to a fluid-like state by resumption of process conditions.

By way of contrast, runs three and four, in which the solvent is diverted through conduit 42 by closing block valve 20 and opening diverter valve 40 and heating fluid is introduced into heating jackets to maintain the operating conditions within the apparatus containing the feed mixture, are found to be capable of resumption of continuous operation without deashing process shutdown to mechanically clean the apparatus as no solid mass is formed in the apparatus.

Thus, the process of the present invention is seen to provide a means by which the fluid-like properties of the phases within the separation zone of a continuous coal deashing process can be maintained during interruption of the flow of feed to the process apparatus. This provides a more economical deashing process in that less down-time for maintenance is required to maintain continuous process operation.

The term "solvent" as used herein refers to an organic liquid solvent consisting essentially of at least one substance having a critical temperature below 800 degrees F. selected from the group consisting of aromatic hydrocarbons having a single benzene nucleus and normal boiling points below about 310 degrees F., cycloparaffin hydrocarbons having normal boiling points below about 310 degrees F., open chain mono-olefin hydrocarbons having normal boiling points below about 310 degrees F., open chain saturated hydrocarbons having normal boiling points below about 310 degrees F., mono-, di, and tri-open chain amines containing from about 2–8 carbon atoms, carbocyclic amines having a monocyclic structure containing from about 6–9 carbon atoms, heterocyclic amines containing from about 5–9 carbon atoms, and phenols containing from about 6–9 carbon atoms and their homologs.

The term "insoluble coal products" as used herein means the undissolved coal, mineral matter and other solid inorganic particulate matter and the like which is insoluble in the solvent under the conditions of this invention.

While the subject invention has been described with respect to what at present is considered to be the preferred embodiments thereof, it is to be understood that changes or modifications can be made in the process or apparatus without departing from the spirit or scope of the invention as defined by the following claims.

What is claimed is:

1. In a coal deashing process for separating a feed mixture into a light phase and a heavy phase having fluid-like properties within a separation zone, said separation zone being maintained at an elevated temperature and at a pressure greater than 550 psig. to effect said separation, said feed mixture being formed by contacting, in a mixing zone, a feed comprising soluble coal products and insoluble coal products with a solvent maintained at an elevated temperature and pressure, said feed mixture being in a ratio by weight of solvent to feed greater than one, said solvent consisting essentially of at least one substance having a critical temperature below 800 degrees F. selected from the group consisting of aromatic hydrocarbons having a single benzene nucleus and normal boiling points below about 310 degrees F., cycloparaffin hydrocarbons having normal boiling points below about 310 degrees F., open chain mono-olefin hydrocarbons having normal boiling points below about 310 degrees F., open chain saturated hydrocarbons having normal boiling points below about 310 degrees F., mono-, di, and tri-open chain amines containing from about 2–8 carbon atoms, carbocyclic amines having a monocyclic structure containing from about 6–9 carbon atoms, heterocyclic amines containing from about 5–9 carbon atoms, and phenols containing from about 6–9 carbon atoms and their homologs, said feed mixture being separated in said separation zone into said light phase and said heavy phase after which said light phase and said heavy phase are individually withdrawn from said separation zone, the improvements which comprise, during periods in which flow of said feed to said mixing zone is interrupted:

(a) providing an alternate solvent flow path by which the flow of said solvent maintained at elevated temperature and pressure is diverted from said mixing zone during said periods in which flow of said feed to said mixing zone is interrupted and is introduced into a conduit through which said light phase is withdrawn from said separation zone to maintain the elevated pressure within said separation zone; and (b) maintaining the temperature level of said separation zone from which the flow of said solvent has been diverted at said elevated temperature while also maintaining said elevated pressure level to maintain the fluid-like properties of said heavy phase.

2. The process of claim 1 wherein said separation zone is maintained at an elevated temperature and pressure to effect a separation of said feed defined further as:

maintaining said separation zone at a temperature level in the range of from about 400 degrees F. to about 700 degrees F. and a pressure level in the range of from about 600 psig to about 1500 psig.

3. The process of claim 1 wherein maintaining the temperature level of said separation zone about which the flow of said solvent is diverted is defined further as:

introducing a heating fluid into a heating jacket surrounding the apparatus of said separation zone to maintain the elevated temperature within said separation zone.

4. The process of claim 1 defined further to include the step of:

maintaining the elevated temperature and pressure within said mixing zone about which the flow of said solvent is diverted to maintain said feed mixture contained therein in equilibrium and thereby retain the fluid-like properties of said feed mixture.

5. The process of claim 4 wherein maintaining the temperature level within said mixing zone is defined further as:

introducing a heating fluid into a heating jacket surrounding the apparatus of said mixing zone to maintain the elevated temperature within said mixing zone.

6. The process of claim 1 defined further to include the step of:

returning the flow of said diverted solvent from said alternate solvent flow path to a flow path through said mixing zone and said separation zone in such a manner as to maintain the elevated pressure within said separation zone upon termination of the feed flow interruption.

7. The process of claim 1 wherein providing an alternate solvent flow path is defined further as:

providing an alternate flow path by which the flow of elevated temperature and pressure solvent is diverted around said mixing zone and said separation zone during periods in which flow of said feed is interrupted while maintaining fluid communication between said separated phases within said separation zone and said diverted solvent to maintain said elevated pressure within said separation zone.

8. In a coal deashing process for separating a feed mixture into a light phase and a heavy phase having fluid-like properties within a separation zone, said separation zone being maintained at an elevated temperature and at a pressure greater than 550 psig. to effect said separation, said feed mixture being formed by contacting, in a mixing zone, a feed comprising soluble coal products and insoluble coal products with a solvent maintained at an elevated temperature and pressure, said feed mixture being in a ratio by weight of solvent to feed greater than one, said solvent consisting essentially of at least one substance having a critical temperature below 800 degrees F. selected from the group consisting of aromatic hydrocarbons having a single benzene nucleus and normal boiling points below about 310 degrees F., cycloparaffin hydrocarbons having normal boiling points below about 310 degrees F., open chain mono-olefin hydrocarbons having normal boiling points below about 310 degrees F., open chain saturated hydrocarbons having normal boiling points below about 310 degrees F., mono-, di, and tri-open chain amines containing from about 2–8 carbon atoms, carbocyclic amines having a monocyclic structure containing from about 6–9 carbon atoms, hererocyclic amines containing from about 5–9 carbon atoms, and phenols containing from about 6–9 carbon atoms and their homologs, said feed mixture being introduced into said separation zone through an entry conduit and separated in said separation zone into said light phase and said heavy phase, and said light phase and said heavy phase are withdrawn through a light phase withdrawal conduit and a heavy phase withdrawal conduit, respectively, from said separation zone, the improvements which comprise, during periods in which flow of said feed to said mixing zone is interrupted:

(a) providing an alternate solvent flow path by which the flow of said solvent maintained at elevated temperature and pressure is diverted from said mixing zone during said periods in which flow of said feed to said mixing zone is interrupted, and maintaining fluid communication through said light phase withdrawal conduit between said diverted solvent and said separated phases in said separation zone to maintain said elevated pressure level within said separation zone;

(b) providing means for blocking said feed mixture entry conduit to said separation zone to assist in maintaining said elevated pressure within said separation zone;

(c) providing means for blocking said heavy phase withdrawal conduit to assist in maintaining said elevated pressure within said separation zone; and (d) maintaining the temperature level of said separation zone at the elevated temperature level at which said separation is effected while also maintaining said elevated pressure level to maintain the fluid-like properties of said heavy phase.

* * * * *